US007761964B2

(12) United States Patent
Foster

(10) Patent No.: US 7,761,964 B2
(45) Date of Patent: Jul. 27, 2010

(54) STRUCTURING NEEDLE FOR TREATING FIBER WEBS

(75) Inventor: Perk Foster, Manitowoc, WI (US)

(73) Assignee: Groz-Beckert KG, Albstadt (DE)

( * ) Notice: Subject to any disclaimer, the term of this patent is extended or adjusted under 35 U.S.C. 154(b) by 1113 days.

(21) Appl. No.: 10/844,576

(22) Filed: May 13, 2004

(65) Prior Publication Data

US 2005/0251978 A1 Nov. 17, 2005

(51) Int. Cl.
*D04H 18/00* (2006.01)

(52) U.S. Cl. ..... 28/115

(58) Field of Classification Search ..... 28/115, 28/107; 26/1, 29 R, 31
See application file for complete search history.

(56) References Cited

U.S. PATENT DOCUMENTS

| | | | | | |
|---|---|---|---|---|---|
| 2,180,633 | A | * | 11/1939 | Holt | 81/461 |
| 2,815,054 | A | * | 12/1957 | Cummaro | 81/441 |
| 2,873,507 | A | * | 2/1959 | Kelson | 28/115 |
| 3,479,708 | A | * | 11/1969 | Foster | 28/115 |
| 3,727,276 | A | | 4/1973 | Foster | |
| 3,731,352 | A | * | 5/1973 | Okamoto et al. | 28/112 |
| 3,753,412 | A | * | 8/1973 | Shepard et al. | 112/222 |
| 3,792,512 | A | | 2/1974 | Zocher | |
| 4,037,297 | A | * | 7/1977 | Foster | 28/115 |
| 4,110,875 | A | * | 9/1978 | Foster | 28/115 |
| 4,309,800 | A | | 1/1982 | Foster | |
| 4,480,514 | A | * | 11/1984 | Ponziani | 81/461 |
| 4,955,936 | A | * | 9/1990 | Douglas | 81/441 |

FOREIGN PATENT DOCUMENTS

| | | | |
|---|---|---|---|
| DE | 720664 | * | 5/1942 |
| DE | 2038478 | * | 2/1972 |
| DE | 2038478 | | 10/1986 |
| GB | 1304732 | * | 1/1973 |
| GB | 2089856 | * | 6/1982 |

* cited by examiner

*Primary Examiner*—Danny Worrell
(74) *Attorney, Agent, or Firm*—Fitch, Even, Tabin & Flannery; Norman N. Kunitz

(57) ABSTRACT

A structuring needle for treating a fiber web by repeatedly penetrating thereinto, includes a shank, a working-part tip constituting an end of the shank and a multi-branch recess formed in the working-part tip. The multi-branch recess is composed of a plurality of generally groove-shaped branches. At least some of the branches are oriented to one another at an angle other than 180°.

15 Claims, 3 Drawing Sheets

STRUCTURING NEEDLE FOR TREATING FIBER WEBS

BACKGROUND OF THE INVENTION

This invention relates to a structuring needle for working on felts, fiber batts, woven or knit fabric, also referred to collectively as a fiber web. By structuring needle there is meant a needle which works on a generally pre-compacted (pre-reinforced) material to lend it a desired structure.

Numerous types of structuring needles are in use in the manufacture of felts. The structuring needles are in most cases secured in a large number to a needle board of a structuring machine, and are caused to repeatedly pierce a pre-compacted material, such as a fiber batt, as the needle board executes swinging motions. This procedure results in a structuring of the fiber batt.

For such an operation frequently structuring needles are used, whose tip is provided with a groove-like recess. As a result of such a construction, individual filaments of the batt to be structured are captured by the recess at the tip of the structuring needle and pushed through the pre-compacted batt. Such a structuring needle is described in U.S. Pat. No. 3,792,512. The recess provided at the tip of the structuring needle (termed as a fork needle in that patent) is formed on either side by tines of more or less equal or different lengths.

U.S. Pat. No. 4,309,800 discloses a structuring needle (termed as a felting needle in that patent) provided with a recess at its working-part tip. The markedly flat recess has a groove-like structure of approximately triangular cross section.

U.S. Pat. No. 3,727,276 shows a structuring needle (termed as a felting needle in that patent), whose working-part tip is provided with a recess formed by a groove of rectangular cross section. The groove bottom is curved in the longitudinal direction of the groove.

As disclosed in German patent document No. DE-OS 2038478, the groove is extended into the working part of the structuring needle, so that it runs parallel to the working part beyond the working-part tip. Further, in the region of the working-part tip the groove has a wide opening, so that the groove flanks form an approximately right angle with one another. It is further disclosed in the German patent document to form at the working-part tip two mutually parallel-oriented notches which are separated from one another by a knife-like ridge. Such structuring needles have several tips, between which filaments may be received for pushing them into the material. Filaments, however, which extend transversely to the recesses may be severed by the central tip.

The different configurations of the shape of the working-part tip affect the properties of the structuring needle during its operation. It has been found, however, that the efficiency of the known structuring needles remains limited which means that a relatively high number of individual punctures is required until the desired structured felt is obtained from the pre-reinforced batt.

SUMMARY OF THE INVENTION

Accordingly, it is an object of the invention to provide an improved structuring needle which has an increased efficiency as compared to needles of the prior art.

This object and others to become apparent as the specification progresses, are accomplished by the invention, according to which, briefly stated, the structuring needle is provided with a multi-branch recess at its working-part tip.

Thus, the structuring needle according to the invention differs from prior art needles by the recess configuration of the working-part tip. As a result, the multi-branch recess is capable of capturing filaments which are at different orientation with respect to one another and the structuring needle. While known structuring needles push only those filaments through the pre-compacted material which lie more or less parallel to the groove (recess) provided at the working-part tip, the structuring needle according to the invention, due to its multi-branch configuration, can catch also those filaments which have different orientations. Thus, for example, filaments can be captured which lie only approximately parallel to one of the brancnes of the multi-branch recess. In this manner the efficiency of the structuring needle is increased, since the number of pushed-through filaments per needle punch is greater, thus allowing a greater feeding speed of the pre-compacted material, resulting in a productivity increase of the structuring machine. Stated differently, the structuring effect per needle punch is increased. Further, by using the structuring needles according to the invention, the appearance of the structured product may be deliberately altered or shaped as opposed to the appearance of conventionally made felts. By using the structuring needles according to the invention, surface structures of the felt may be produced which can be obtained with conventional structuring needles only with excessive outlay of work and expense, if at all Such advantages follow from the fact that filaments lying in many or all directions can be pushed through the pre-compacted material, rather than only those filaments which are oriented in a single selected direction, as it has been the case heretofore.

The multi-branch recess preferably includes a plurality of groove-shaped notches of greater or lesser depth which meet, for example, in the needle center. Preferably, the notches have a U-shaped cross section, that is, the notch bottom has an edgeless transition to the notch flanks. In the alternative, however, it is feasible to provide notches having a rectangular or triangular cross section for influencing the structuring process. Preferably, the notches all have approximately the same width and the same depth. Such an arrangement results in a very effective structuring process without causing major damage to the material. Needle wear is relatively slight and only few filaments are torn or severed.

In principle it is feasible to provide that the notches which converge in a star-like manner toward the central needle axis are arranged at a uniform angular distribution. It is, however, also feasible to dispose the notches at different angular spacing, for example, at regularly alternating angular distances. With such a feature the appearance of the felt can be deliberately influenced.

Between the notches preferably projections are formed which may have an obtuse end and which together constitute a crown. According to a preferred embodiment, however, the projections have pointed ends which lie in a common plane and which preferably directly border a central recess. Such a feature results in highly efficient structuring needles exposed to slight wear and causing unsubstantial filament damage.

The notches may be limited to the immediate region of the working-part tip or may extend along the working part of the structuring needle. Further, the working part may be provided with additional structural elements for capturing filaments and for pushing them into the pre-compacted material.

DESCRIPTION OF THE PREFERRED EMBODIMENTS

Figure 1:
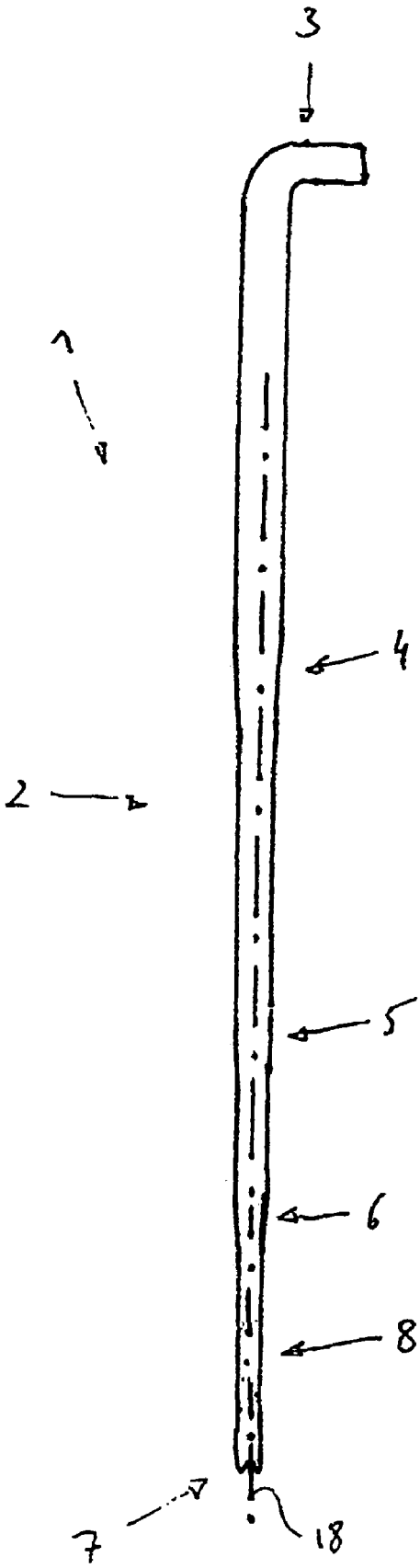
FIG. 1 is a schematic side elevational view of a structuring needle according to the invention.

FIG. 1 illustrates a structuring needle 1 for structuring felts composed of random fibers or webs formed of oriented fibers or for structuring woven or knit fabrics. The structuring needle 1 comprises a shank 2 which has an angled part at one end 3 for facilitating the fastening of the needle 1 to a needle board. The shank 2 is reduced in its diameter at several locations 4, 5, 6, whereby approximately conical transition zones are obtained. Thus, the structuring needle 1 tapers in several steps from one end 3 to its opposite end 7. The last portion of the shank 2 situated between the location 6 and the end 7 is designated as a working part 8 which may have a round or polygonal cross section and which is preferably smooth.

Figure 2:
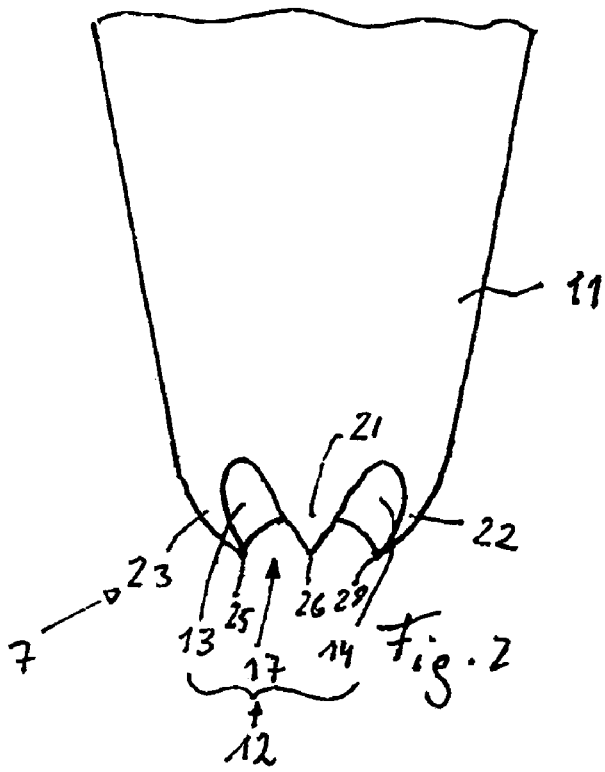
FIG. 2 is an enlarged schematic side elevational view of a preferred embodiment of the working-part tip of the structuring needle shown in FIG. 1.
Figure 4:
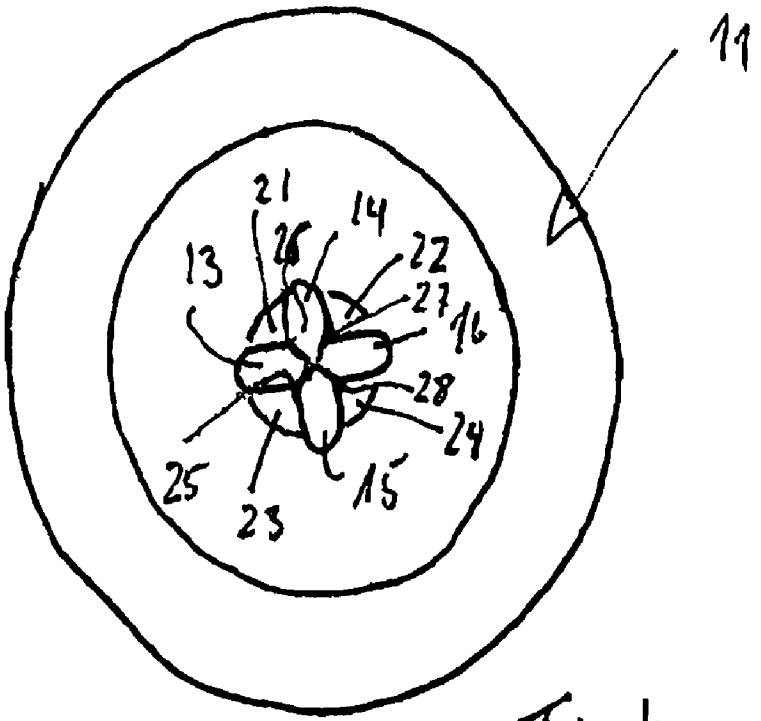
FIG. 4 is a top plan view of the working-part tip shown in FIGS. 2 and 3.
Figure 3:
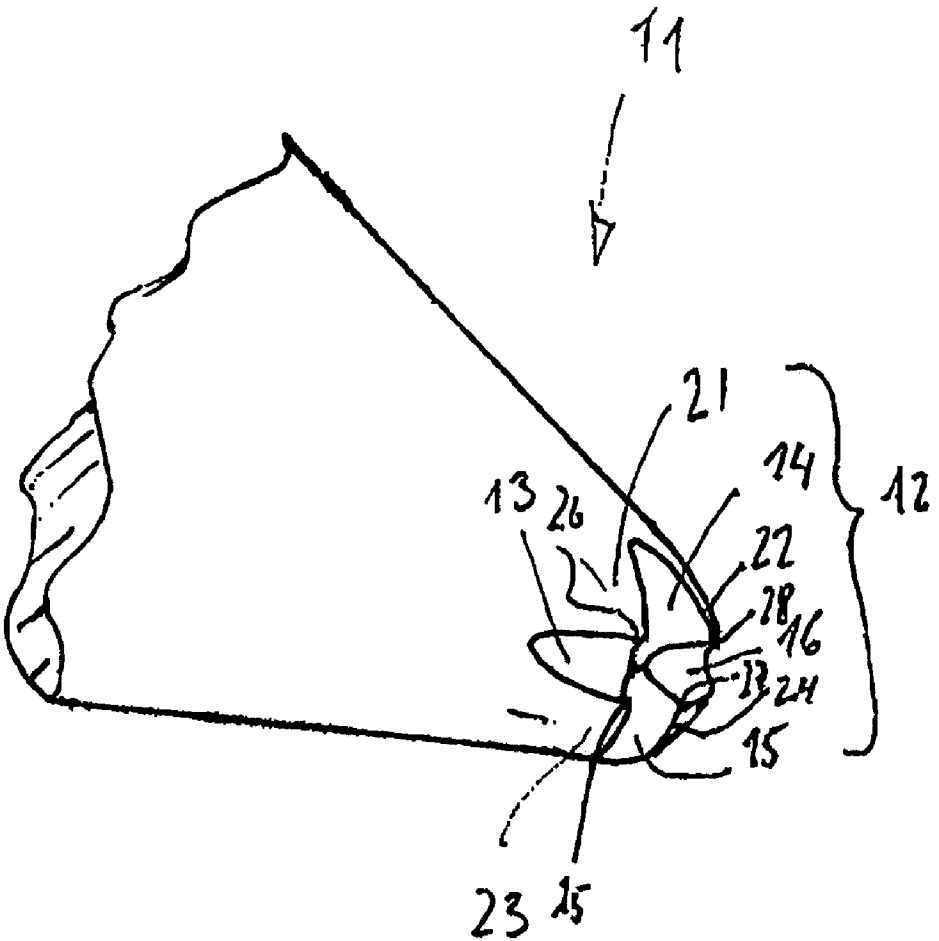
FIG. 3 is a perspective view of the working-part tip shown in FIG. 2.

At the shank end 7 the working part 8 has a working-part tip 11 which is separately illustrated in FIGS. 2, 3 and 4, showing a preferred embodiment of the invention. The working-part tip 11 has the basic shape of a truncated cone or a truncated pyramid, dependent on whether the working-part 8 has a circular or polygonal cross section. At the shank end 7 the working-part tip 11 is slightly rounded to thus obtain a basic shape that has a spherical tip. In the spherical tip a multi-branch recess 12 is formed. The branches of the multi-branch recess 12 are obtained by providing therein a plurality of notches 13, 14, 15, 16 which merge in a central recess 17 which, in turn, is arranged preferably centrally to a longitudinal shank axis 18. In particular, the shank axis 18 coincides with the longitudinal axis of the working part 8.

As may be observed in FIG. 4, the notches 13 to 16 are arranged at a uniform angular spacing of 90°, thus lending the recess 12 a cross-shaped configuration. The notches 13 to 16 are of equal length and have a bottom which slopes in the direction of the shank end 7, toward the central recess 17. The notches 13 to 16 rise outward, in the direction of the working part 8 and have an open end lying in the outer surface of the working-part tip 11. The cross section of the notches 13 to 16 is U-shaped, and the bottom of each notch 13 to 16 merges without a step or ledge or edge into the adjoining notch flank. The facing flanks of each notch 13 to 16 form an acute angle with one another, If required, however, the flanks may be oriented parallel to one another.

Between the notches 13 to 16 projections 21, 22, 23, 24 are formed which, as may be observed in FIG. 4, are of triangular shape in top plan view, that is, when viewed in a direction parallel to the axis 18, with the shank end 7 facing the observer. The outer surface of the projections 21 to 24 is preferably spherically curved and terminates in a respective point 25, 26, 27, 28; these points preferably lie in a common plane that is perpendicular to the central axis 18. In the alternative, the points 25 to 28 may be rounded, particularly for the purpose of reducing wear.

The facing notches 13, 16; 14, 15 lie on respective lines which intersect the axis 18 and which intersect each other at 90°. It is, however, feasible to provide for an intersection of less than 90°, in which case the notches 13 to 16 are arranged in an X pattern thus forming alternatingly wide and narrow projections 21 to 24.

In the discussion which follows, the operation of the above-described structuring needle 1 will be set forth.

A large number of mutually parallel structuring needles 1 of FIG. 1 are fastened to a needle board and are oriented to point toward a web composed of random fibers The structuring needles 1 are of identical construction and alignment. As an alternative, it is feasible to additionally attach conventional structuring needles to the needle board, in which case the conventional needles and the needles according to the invention alternate individually or in groups.

For compacting the random-fiber web, that is, for forming the desired felt, the needle board is moved in rapid succession such that the structuring needles 1 repeatedly penetrate into the random-fiber web at least with their working part 8. At the same time, the random-fiber web is slowly advanced under the needle board, so that each structuring needle 1 penetrates the web at a new location as each piercing step occurs.

In the course of each piercing step, the working-part tip 11 captures the filaments situated in its path and pushes the filaments into the web. Filaments disposed both longitudinally and transversely to the advancing motion of the web are captured due to the crown-shaped configuration of the working-part tip 11, where the projections 21 to 24 form a ring which is concentric to the axis 18 and which surrounds the central recess 17.

Figure 5:
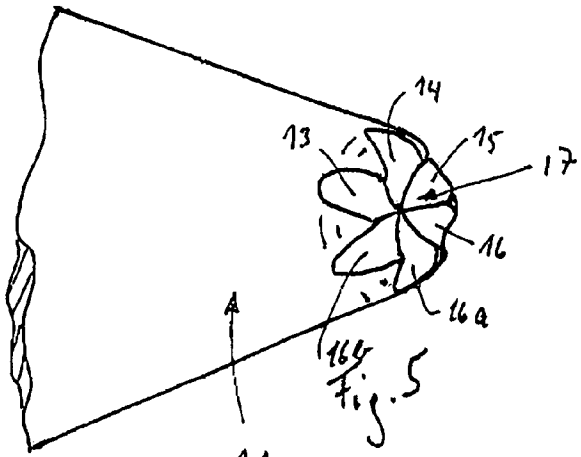
FIG. 5 is a perspective view of another preferred embodiment of the working-part tip.
Figure 6:
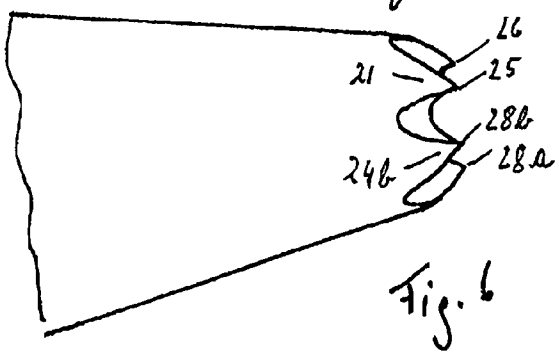
FIG. 6 is a side elevational view of the working-part tip shown in FIG. 5.
Figure 7:
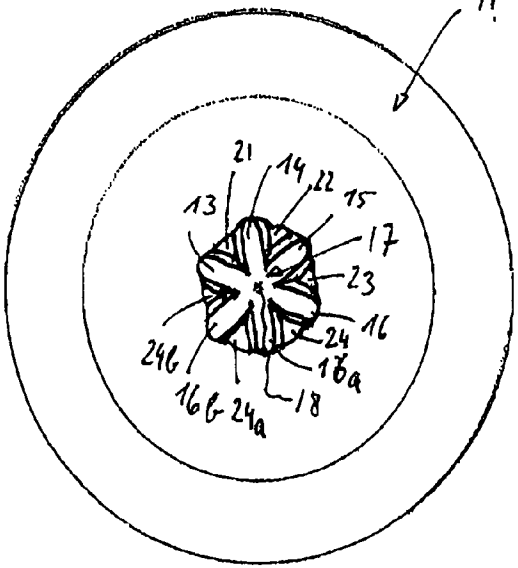
FIG. 7 is a top plan view of the working-part tip shown in FIG. 5.

In the embodiment shown in FIGS. 5, 6 and 7 the working-part tip 11 is provided with six notches 13, 14, 15, 16, 16*a*, 16*b* spaced from one another at 60° and merging at the central recess 17 which is concentric to the axis 18, whereby a multi-branch recess 12' is formed. As concerns the configuration of the notches 13 to 16*b* as well as the projections 21, 22, 23, 24, 24*a*, 24*b* situated therebetween, the same considerations apply as those set forth in connection with the embodiment shown in FIGS. 2 to 4. The projections 21 to 24*b* have pointed ends, four of which are visible in FIG. 6 and are designated at 25, 26, 28*a*, 28*b*. The projection ends, as well as the edges bordering the projections 21 to 24*b* may be rounded to provide for a gentler treatment of the filaments.

The embodiment of FIGS. 5, 6 and 7 is particularly designed for capturing the filaments irrespective of their orientation and for pushing them into the random-fiber web. The working-part tip 11 may also be regarded as a multi-tine fork in which the relatively short and thick tines of the fork are arranged along a circle concentric with the axis 18.

Figure 8:
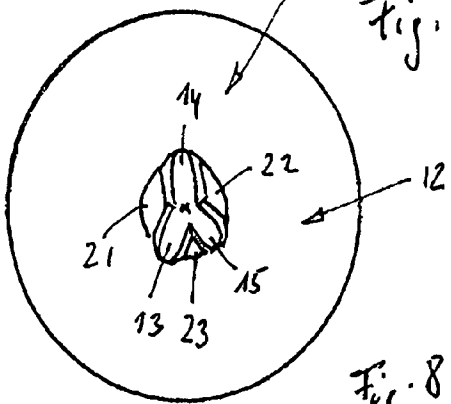
FIG. 8 is a top plan view of yet another preferred embodiment of the working-part tip.

A further embodiment of the working-part tip 11 is illustrated in FIG. 8. That embodiment has only three notches 13, 14, 15 which merge at the central recess 17 to thus form a multi-branch recess 12". While the notches 13, 15 are closely adjoining, they define an angle with the notch 14 that is greater than 120°. The projections 21, 22, 23 situated between the notches 13, 14, 15 are accordingly differently sized. The structuring needle incorporating this embodiment of the working-part tip has a certain preference as concerns the capture of filaments which are oriented more or less parallel to the axis 18 and do not appreciably deviate from such an orientation. Nevertheless, the tendency to capture filaments is greater than in case of conventional fork needles which have only a single, throughgoing, un-branched recess.

In all of the above-described embodiments an additional projection may be provided in the middle of the central recess 17, approximately concentrically to the axis 18. It is further feasible to deepen the central recess 17 or to arrange the notches 13 to 16 (16*a*, 16*b*) along the working part 8 parallel to the axis 18 or at an angle thereto.

In recapitulation of the described, exemplary preferred embodiments, the structuring needle 1 according to the invention includes a working part 8 which, at its free end, terminates in a working-part tip 11. The latter is provided with a recess 12 (embodiment of FIGS. 2, 3, 4), 12' (embodiment of FIGS. 5, 6, 7) or 12" (embodiment of FIG. 8), having a multi-branched configuration. Thus, at least three projections 21, 22, 23 are provided which are arranged about the needle axis 18 and which surround a central recess 17. Between the projections notches 13, 14, 15 (or groove-like or slot-like recesses) are arranged to capture and carry filaments of a random-fiber web or pre-compacted batt.

More generally, the inventive multi-branch recess of the structuring needle is a construction which is composed of a plurality of groove-shaped or slot-shaped branches, such as notches, and at least some of the branches are oriented to one another at an angle other than 180°.

The structuring needle according to the invention is adapted for treating a random-fiber web, or a pre-compacted batt and is also adapted for a post-treatment of flat textile fabrics having a well-ordered thread pattern, such as woven or knit materials. The structuring needle according to the invention is further adapted for producing combined flat products which include, for example, a flat random-fiber component, or an additional, for example, also flat, well-ordered component, such as a woven or knit material. The structuring needle according to the invention has a high degree of fiber-capturing and fiber-advancing efficiency and operates with slight damage to the filaments.

It will be understood that the above description of the present invention is susceptible to various modifications, changes and adaptations, and the same are intended to be comprehended within the meaning and range of equivalents of the appended claims.

What is claimed is:

1. A structuring needle for working a fiber web, said needle comprising a shank, a working-part tip constituting an end of said shank having a narrowing tapered outer surface and a multibranch recess formed in said working-part tip and being composed of at least three groove-shaped branches for receiving fibers of the web when an end of the working part tip of the needle is pushed through a fiber web, said branches extending outwardly from a central recess, where the branches merge, and defining at least three projections there-between.

2. The structuring needle as defined in claim 1, wherein said multibranch recess is star shaped.

3. The structuring needle as defined in claim 1, wherein said groove-shaped branches are uniformly angularly spaced from one another.

4. The structuring needle as defined in claim 1, wherein an angular spacing between adjoining groove-shaped branches is non-uniform.

5. The structuring needle as defined in claim 1, wherein said shank has a central longitudinal axis; and said central recess is disposed centrally to said axis.

6. The structuring needle as defined in claim 1, wherein said projections together form a crown-shaped assembly.

7. The structuring needle as defined in claim 6, wherein each said projection has an end that forms only a single point.

8. The structuring needle as defined in claim 6, wherein said shank has a central longitudinal axis; and further wherein said projections are triangular when viewing said working-part tip in a direction parallel to said axis.

9. A structuring needle as defined in claim 1, wherein the end of the working-part tip has a spherical outer surface.

10. A structuring needle as defined in claim 1, wherein said groove-shaped branches extend outwardly from said central recess to an outer peripheral surface of the working-part tip.

11. A structuring needle as defined in claim 1, wherein facing flanks of each respective groove-shaped branch form an acute angle with one another.

12. A structuring needle as defined in claim 1, wherein the groove-shaped branches are generally U-shaped in cross section.

13. A structuring needle as defined in claim 1, wherein the projections are generally triangular in shape when viewed in a direction parallel to a longitudinal axis of the shank.

14. A structuring needle as defined in claim 13, wherein each of the projections has a respective end that forms only a substantially single point, with all of the points lying in a common plane perpendicular to the longitudinal axis of the shank at the working-part tip.

15. A structuring needle as defined in claim 1 wherein the groove-shaped branches are all of equal depth.

* * * * *